US010391614B1

(12) United States Patent
Aldredge

(10) Patent No.: US 10,391,614 B1
(45) Date of Patent: Aug. 27, 2019

(54) LOCKING PLIERS

(71) Applicant: Robert L. Aldredge, Englewood, OH (US)

(72) Inventor: Robert L. Aldredge, Englewood, OH (US)

( * ) Notice: Subject to any disclaimer, the term of this patent is extended or adjusted under 35 U.S.C. 154(b) by 0 days.

(21) Appl. No.: 16/254,663

(22) Filed: Jan. 23, 2019

(51) Int. Cl.
*B25B 7/12* (2006.01)

(52) U.S. Cl.
CPC ..... *B25B 7/123* (2013.01)

(58) Field of Classification Search
CPC ..... B25B 7/123; B25B 7/14; B25B 7/16
See application file for complete search history.

(56) References Cited

U.S. PATENT DOCUMENTS 5,056,385 A 10/1991 Petersen
8,656,813 B1 * 2/2014 Aldredge ..... B25B 7/12 81/368
8,984,993 B1 * 3/2015 Aldredge ..... B25B 7/12 81/367
9,352,454 B1 * 5/2016 Aldredge ..... B25B 7/123
9,533,400 B1 * 1/2017 Aldredge ..... B25B 7/12
9,682,463 B1 6/2017 Aldredge et al.

* cited by examiner

*Primary Examiner* — David B. Thomas
(74) *Attorney, Agent, or Firm* — Donald J. Ersler

(57) ABSTRACT

A locking pliers preferably includes a fixed jaw, a moveable jaw, a fixed handle, an adjusting screw, a toggle link, at least one power link, a curved link and a moveable handle. The fixed jaw is retained in a first end of the fixed handle. The moveable jaw is pivotally retained in the first end of the fixed handle. An adjustment screw is retained in a second end of the fixed handle. An end of the adjustment screw engages a first end of the toggle link. The moveable handle is pivotally engaged with the toggle link and a first end of the curved link. A first end of the power link is pivotally engaged with a second end of the toggle link. A second end of the curved link is pivotally engaged with the power link. The moveable jaw is pivotally engaged with a second end of the power link.

20 Claims, 4 Drawing Sheets

LOCKING PLIERS

BACKGROUND OF THE INVENTION

1. Field of the Invention

The present invention relates generally to hand tools and more specifically to a locking pliers, which requires less effort to operate than that of the prior art.

2. Discussion of the Prior Art

U.S. Pat. No. 5,056,385 to Petersen discloses a compound toggle link. U.S. Pat. No. 9,682,463 to Aldredge et al. discloses a locking pliers.

Accordingly, there is a clearly felt need in the art for a locking pliers, which requires less effort to operate than that of the prior art.

SUMMARY OF THE INVENTION

The present invention provides a locking pliers, which requires less effort to operate than that of the prior art. The locking pliers preferably includes a fixed jaw, a moveable jaw, a fixed handle, an adjusting screw, a toggle link, at least one power link, a curved link and a moveable handle. The fixed jaw, the moveable jaw, the fixed handle, the adjusting screw and a biasing spring are preferably taken from an Irwin item no. 502L3 vise grips, but other parts may also be used. U.S. Pat. No. 5,056,385 is hereby incorporated into this patent application by reference in its entirety. The fixed jaw is retained in one end of the fixed handle and the adjusting screw is threadably retained in an opposing end of the fixed handle. The moveable jaw is pivotally retained in the one end of the fixed handle.

The toggle link preferably includes a first toggle end, a second toggle end and a stop projection. An inward curved surface is formed in the first toggle end to receive an end of the adjusting screw. Each power link includes a first power end and a second power end. The second toggle end of the toggle link is pivotally retained on the first power end of the at least one power link with a first power pin. It is preferable to have two power links, which are retained on opposing sides of the toggle link. The second power end of the at least one power link is pivotally retained on an end of the moveable jaw with a second power pin. The moveable handle includes a U-shaped cross section and a yoke end. A first handle hole is formed through a first leg of the yoke end and a second handle hole is formed through a second leg of the yoke end.

A toggle hole is formed through the toggle link, adjacent the first power pin and on the same axis as the first power pin. A first handle pin is inserted through the first handle hole and pressed into the toggle hole to pivotally retain the moveable handle relative to the toggle link. A second handle pin is inserted through the second handle hole and pressed into a first link hole in a first end of the curved link. A middle power hole is formed through substantially a middle of the at least one power link. A second power pin is inserted through the middle power hole in the power link and pressed into a second link hole in a second end of the curved link.

Accordingly, it is an object of the present invention to provide a locking pliers, which requires less effort to operate than that of the prior art.

These and additional objects, advantages, features and benefits of the present invention will become apparent from the following specification.

DETAILED DESCRIPTION OF THE PREFERRED EMBODIMENTS

Figure 1:
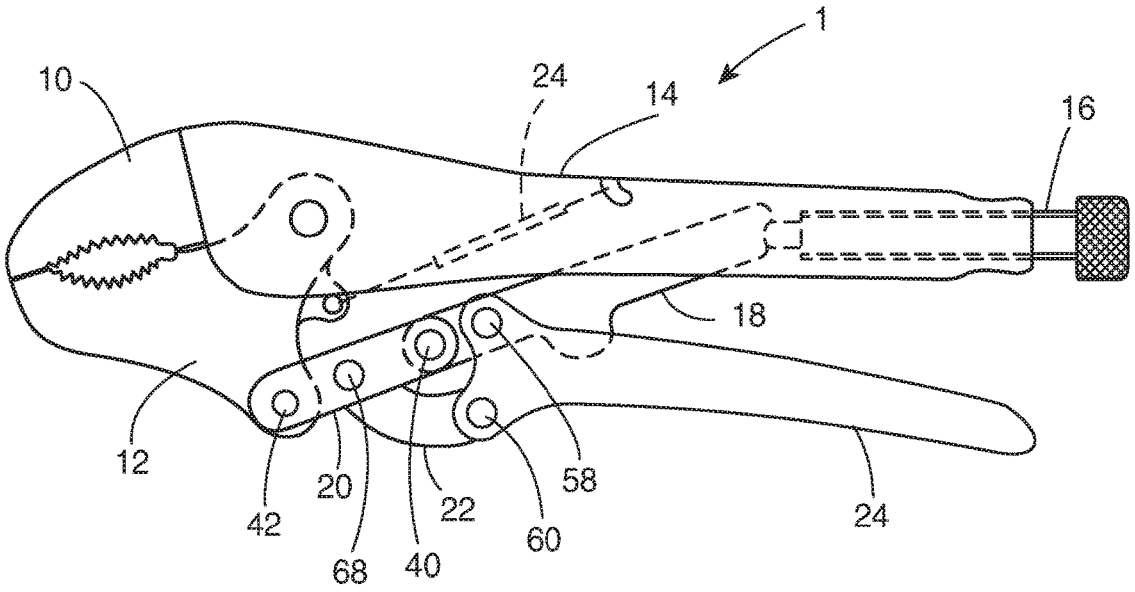
FIG. 1 is a side view of a locking pliers in a closed orientation in accordance with the present invention.

With reference now to the drawings, and particularly to FIG. 1, there is shown a side view of a locking pliers 1 in a closed orientation. With reference to FIGS. 2-5, the locking pliers 1 preferably includes a fixed jaw 10, a moveable jaw 12, a fixed handle 14, an adjusting screw 16, a toggle link 18, at least one power link 20, a curved link 22 and a moveable handle 24. The fixed jaw 10, the moveable jaw 12, the fixed handle 14, the adjusting screw 16 and a biasing spring 26 are preferably taken from an Irwin item no. 502L3 vise grips, but other parts may also be used. U.S. Pat. No. 5,056,385 is hereby incorporated into this patent application by reference in its entirety. The fixed jaw 10 is retained in one end of the fixed handle 14 and the adjusting screw 16 is threadably retained in an opposing end of the fixed handle 14. The moveable jaw 12 is pivotally retained in the one end of the fixed handle 14.

The toggle link 18 preferably includes a first toggle end 28, a second toggle end 30 and a stop projection 32. The stop projection 32 acts as a past top dead center stop for locking the jaws 10, 12 of the locking pliers 1. An inward curved surface 34 is formed in the first toggle end 28 to receive an end of the adjusting screw 16. Each power link 20 includes a first power end 36 and a second power end 38. The second toggle end 30 of the toggle link 18 is pivotally retained on the first power end 36 of the at least one power link 20 with a first power pin 40. It is preferable to have two power links 20, which are retained on opposing sides of the toggle link 18. The second power end 38 of the at least one power link 20 is pivotally retained on an end of the moveable jaw 12 with a second power pin 42. The moveable handle 24 includes a U-shaped cross section and a yoke end 44. A first handle hole 48 is formed through a first leg 46 of the yoke end 44 and a second handle hole 52 is formed through a second leg 50 of the yoke end 44. The U-shaped cross section includes a first side member 25, a second side member 27 and a base member 29.

A toggle hole 54 is formed through the toggle link 18, adjacent the first power pin 40 and preferably on a lengthwise axis 56 of the toggle link 18. The first power pin 40 is preferably centered on the lengthwise axis 56. A first handle pin 58 is inserted through the first handle hole 48 and pressed into the toggle hole 54 to pivotally retain the moveable handle 24 relative to the toggle link 18. A second handle pin 60 is inserted through the second handle hole 52 and pressed into a first link hole 64 in a first end 62 of the curved link 22. A middle power hole 66 is formed through substantially a middle of the at least one power link 20. A second power pin 68 is inserted through the middle power hole 66 in the power link 20 and pressed into a second link hole 72 in a second end 70 of the curved link 22. The curved link 22 includes a curved centerline 74.

Figure 2:
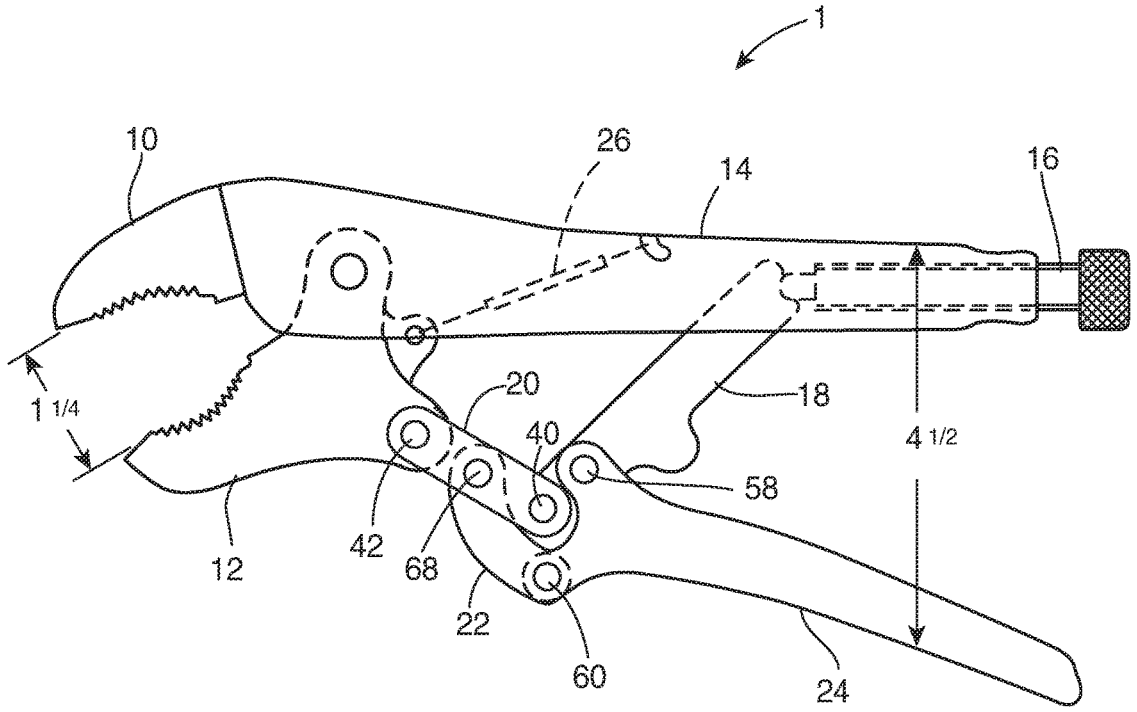
FIG. 2 is a side view of a locking pliers in an open orientation in accordance with the present invention.
Figure 3:
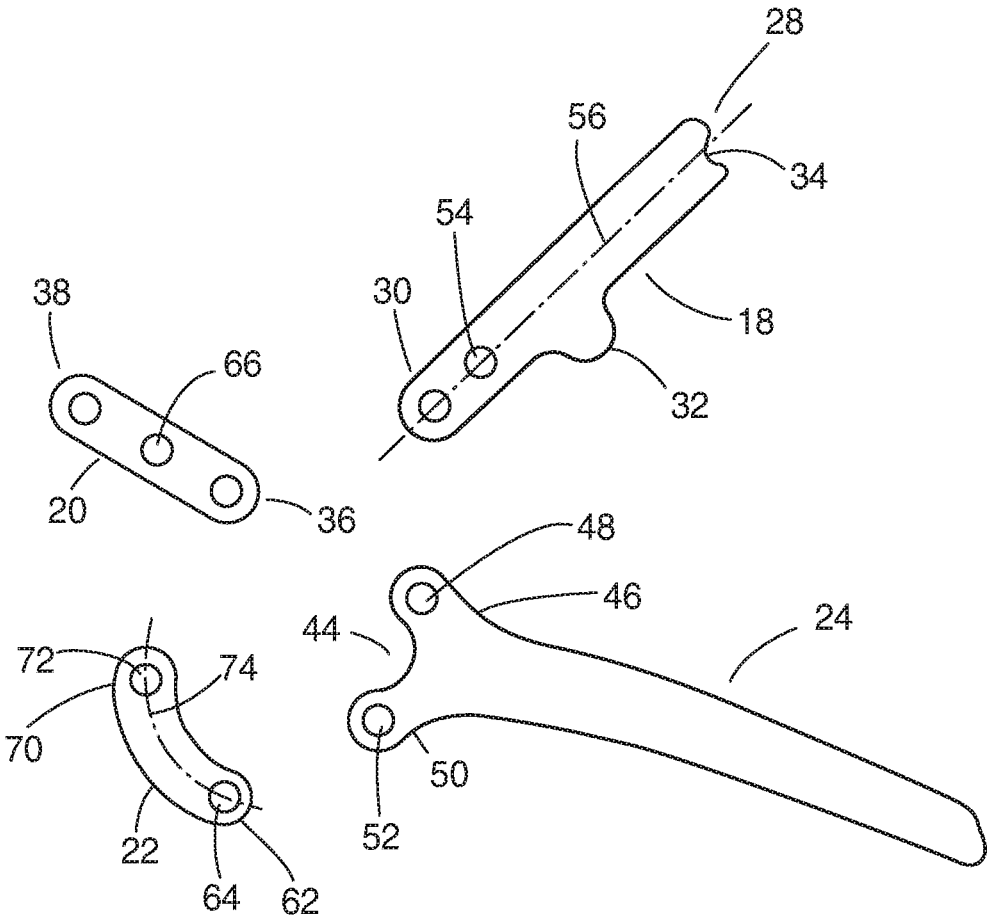
FIG. 3 is an exploded side view of a toggle link, a power link, a curved link and a moveable handle of a locking pliers in an open orientation in accordance with the present invention.
Figure 4:
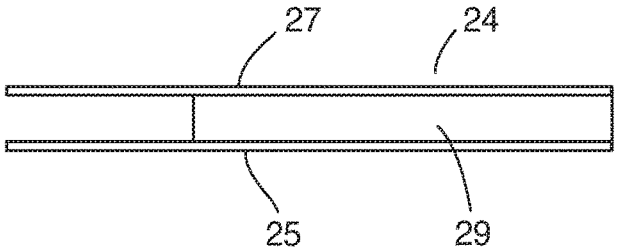
FIG. 4 is a top view of a moveable handle of a locking pliers in accordance with the present invention.
Figure 5:
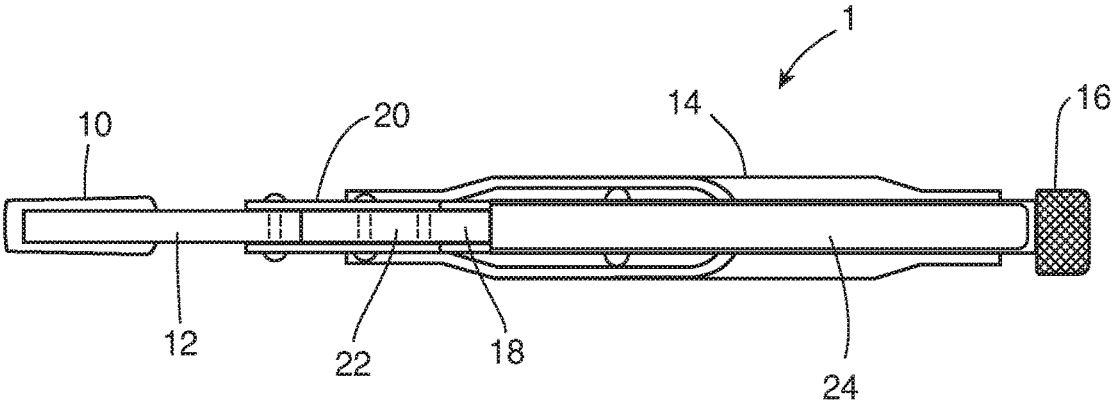
FIG. 5 is a bottom view of a locking pliers in a closed orientation in accordance with the present invention.

The following dimensions are given by way of example and not by way of limitation. With reference to FIG. 2, it is preferable that when the locking pliers 1 is in an open orientation that the inner open jaw distance is about 1.25 inches and the distance between a top of the fixed handle 14 and a bottom of the moveable handle 24 is about 4.25 inches. The distance of 4.25 inches allows most male hands to hold the locking pliers 1 with one hand while manipulating a part to be clamped with the other hand. In a closed orientation the locking pliers will exert as much pressure on a clamped item as a prior art vise grips.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

at least one power link is pivotally engaged with said moveable jaw;

a moveable handle;

a toggle link having a first end and a second end, said first end of said toggle link is in contact with an end of said adjusting device, said second end of said toggle link is pivotally engaged with said at least one power link, said toggle link is pivotally engaged with said moveable handle; and a curved link having one end pivotally engaged with said moveable handle and an opposing end pivotally engaged with said at least one power link.

2. The locking pliers of claim 1 wherein:

said adjusting device is an adjustment screw.

3. The locking pliers of claim 1 wherein:

said moveable handle includes a U-shaped cross section.

4. The locking pliers of claim 3 wherein:

an inner width of said of said U-shaped cross section is sized to receive a thickness of said toggle link and two said at least one power link.

5. The locking pliers of claim 1 wherein:

said curved link includes a curved centerline.

6. The locking pliers of claim 1 wherein:

a stop projection extends from said toggle link.

7. The locking pliers of claim 1 wherein:

said moveable handle includes a yoke end, said yoke end includes a first leg and a second leg, a first handle hole is formed through said first leg, a second handle hole is formed through said second leg.

8. A locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

at least one power link having a first end and a second end, said first end of said power link is pivotally engaged with said moveable jaw;

a moveable handle;

a toggle link having a first end and a second end, said first end of said toggle link is in contact with an end of said adjusting device, said second end of said toggle link is pivotally engaged with said second end of said at least one power link, said toggle link is pivotally engaged with said moveable handle; and a curved link having one end pivotally engaged with said handle and an opposing end pivotally engaged with said moveable handle.

9. The locking pliers of claim 8 wherein:

said adjusting device is an adjustment screw.

10. The locking pliers of claim 8 wherein:

said moveable handle includes a U-shaped cross section.

11. The locking pliers of claim 10 wherein:

an inner width of said of said U-shaped cross section is sized to receive a thickness of said toggle link and two of said power links.

12. The locking pliers of claim 8 wherein:

said curved link includes a curved centerline.

13. The locking pliers of claim 8 wherein:

a stop projection extends from said toggle link.

14. The locking pliers of claim 8 wherein:

said moveable handle includes a yoke end, said yoke end includes a first leg and a second leg, a first handle hole is formed through said first leg, a second handle hole is formed through said second leg.

15. A locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

at least one power link is pivotally engaged with said moveable jaw;

a moveable handle;

a toggle link having a first end and a second end, said first end of said toggle link is in contact with an end of said adjusting device, said second end of said toggle link is pivotally engaged with said at least one power link, said toggle link is pivotally engaged with one end of said moveable handle; and a curved link having one end pivotally engaged with said one end of said moveable handle and an opposing end pivotally engaged with substantially a middle of said at least one power link.

16. The locking pliers of claim 15 wherein:

said adjusting device is an adjustment screw.

17. The locking pliers of claim 15 wherein:

said moveable handle includes a U-shaped cross section.

18. The locking pliers of claim 17 wherein:

an inner width of said of said U-shaped cross section is sized to receive a thickness of said toggle link and two of said power links.

19. The locking pliers of claim 17 wherein:

said curved link includes a curved centerline.

20. The locking pliers of claim 15 wherein:

a stop projection extends from said toggle link.

* * * * *